US011111634B2

(12) United States Patent
Beutler et al.

(10) Patent No.: US 11,111,634 B2
(45) Date of Patent: Sep. 7, 2021

(54) EXPANSION JOINT CONSTRUCTION AND RAIL SYSTEM HAVING AN EXPANSION JOINT CONSTRUCTION

(71) Applicant: Jörg Beutler, Holzkirchen (DE)

(72) Inventors: Jörg Beutler, Holzkirchen (DE); Artur Katkow, Großbottwar (DE)

(73) Assignee: Jörg Beutler, Holzkirchen (DE)

( * ) Notice: Subject to any disclaimer, the term of this patent is extended or adjusted under 35 U.S.C. 154(b) by 500 days.

(21) Appl. No.: 16/169,541

(22) Filed: Oct. 24, 2018

(65) Prior Publication Data

US 2019/0119860 A1 Apr. 25, 2019

(30) Foreign Application Priority Data

Oct. 25, 2017 (EP) ..... 17198278

(51) Int. Cl.
*E01B 11/00* (2006.01)
*E01B 11/32* (2006.01)
*E01B 25/28* (2006.01)

(52) U.S. Cl.
CPC ..... *E01B 11/00* (2013.01); *E01B 11/32* (2013.01); *E01B 25/28* (2013.01); *E01B 2201/08* (2013.01)

(58) Field of Classification Search
CPC ..... E01B 11/00; E01B 11/32; E01B 25/28; E01B 2201/08
See application file for complete search history.

(56) References Cited

U.S. PATENT DOCUMENTS 8,573,506 B2 * 11/2013 Nogret ..... E01B 11/42 238/122
9,963,833 B2 * 5/2018 Andre ..... E01B 7/28
2011/0192908 A1 * 8/2011 Nogret ..... E01B 11/42 238/122
2016/0083912 A1 * 3/2016 Andre ..... E01B 25/28 246/381
2019/0119860 A1 * 4/2019 Beutler ..... E01B 11/00

FOREIGN PATENT DOCUMENTS

| | | | |
|---|---|---|---|
| CN | 2283080 | Y | 12/1995 |
| CN | 2283080 | Y | 6/1998 |
| CN | 102084061 | A | 6/2011 |
| CN | 102677554 | A | 9/2012 |
| CN | 103669126 | A | 3/2014 |
| CN | 105324532 | A | 2/2016 |
| EP | 2500468 | A1 | 9/2012 |
| EP | 2307617 | B1 | 6/2014 |
| EP | 3014021 | B1 | 7/2017 |
| JP | H10-82002 | A | 3/1998 |
| JP | H10338901 | A | 12/1998 |
| WO | 2015/067134 | A1 | 5/2015 |

OTHER PUBLICATIONS

Mar. 31, 2020, Examination Report No. 1 from Chinese Patent Office (CNIPA) Patent Application No. 201811239728.4.
European Patent Office, European Search Report in EP Application No. 17198278.8 dated May 4, 2018, which is a foreign application that shares the same priority as this U.S. application.

* cited by examiner

*Primary Examiner* — Jason C Smith
(74) *Attorney, Agent, or Firm* — Kolitch Romano LLP

(57) ABSTRACT

An expansion joint construction may include at least one adjustment element movable in a longitudinal direction of the expansion joint construction. The at least one adjustment element may include at least one element for taking up a force applied in a longitudinal direction.

17 Claims, 3 Drawing Sheets

EXPANSION JOINT CONSTRUCTION AND RAIL SYSTEM HAVING AN EXPANSION JOINT CONSTRUCTION

CROSS-REFERENCE TO RELATED APPLICATION

This application claims priority to European Patent Application No. 17198278.8, filed Oct. 25, 2017, which is hereby incorporated by reference.

BACKGROUND

Transport systems for rail-bound vehicles are known to comprise a rail system for guiding said vehicles. The rails can be designed in different variants, e.g. as conventional tracks having two parallel rails, as roller coaster tracks, as a monorail provided in a support structure or a monorail having a support tube and a guide tube arranged below the support tube, etc.

Temperature fluctuations cause length changes in practically every rail system. The changes in length are often absorbed or compensated by a supporting structure of the rail system. However, if the supporting structure is not capable of doing so, joints could be provided between rail sections which act as expansion joints when the rails expand in length.

Another application requiring joints between two rail sections is, for example, the provision of joints at shifting points in which a rail section may be temporarily displaced transversely from the rail track. For example, in the field of roller coasters, but not limited to this field, maintenance work makes it absolutely necessary to provide a maintenance or buffer area for vehicles in which the vehicles can be taken off the track. For removing a vehicle from the track a rail section can be movable transversely to the rail track. This rail section has two ends, each with a gap/joint between each of the ends of the section and the end of the respective adjacent track section. The gaps shall be dimensioned such that a friction-free lateral transfer of the movable rail section is possible even at high temperatures, i.e. under linear expansion of the rail system, without jamming of the ends of the rail section.

At the same time, however, the gap should not be larger than necessary in order to prevent impact when the gap is crossed by a vehicle, so that the occupants are not struck when the vehicle passes the gap. Furthermore, a smaller gap reduces the load/strain applied to the wheel and axle design of the vehicle. In order to prevent large impact, in conventional constructions the joints are often passed at reduced speed resulting in a limitation of the speed characteristics of a roller coaster ride.

In case a positive fit drive mechanism is used (e.g. comprising a powered gear drive, and a gear rack mounted on the rail), the function of the positive fit drive may be interrupted at lower temperatures when the gap is too large for making sure that the positive fit drive is continuously engaged when the vehicle passes the gap. Racks, chains or other meshing elements attached to the rails have a maximum permissible pitch tolerance. Exceeding a pitch limit value or going below a pitch limit value leads to failures and/or increases the wear of the rack/toothing of the drive rollers because of inaccurate engagement. In addition, the vehicle cannot take the maximum driving force as it passes the transition point and thus cannot pass over it at maximum speed. From this point of view, the size of the gap should be kept as small as possible and not exceed a specified target value.

Taking into account the permissible pitch error on the one hand and the required minimum gap width on the other hand, a compromise would have to be found for the gap width that meets both requirements. The range for providing a permissible gap width may be small and thus high precision is required when constructing expansion joints in conventional manner. In some cases the provision of an appropriate gap width may be technically impossible.

SUMMARY

The present disclosure relates to an expansion joint construction and a rail system for a transport system comprising at least one rail and at least one expansion joint construction. On this basis, it is an object of one or more embodiments of the invention to provide an expansion joint construction and a rail system for a transport system that meet the requirements with regard to both temperature expansion on the one hand and meeting a permissible pitch range when using a positive fit drive.

In one or more embodiments, an expansion joint construction comprises at least one adjustment element movable in a longitudinal direction of the construction, wherein at least one adjustment element comprises at least one element for taking up a force applied in a longitudinal direction. Particularly, each or several of the adjustment elements may have/support one on more elements for taking up a force, but not each of the adjustment elements may have element for taking up a force. Each of the elements for taking up a force may be connected with one of the adjustment elements. The elements for taking up a force may be separated from each other so they can move independently from each other, substantially following the longitudinal movement of the respective adjustment element which they are connected with.

In one or more embodiments, the longitudinal direction corresponds to the direction of expansion and the direction of the intended expansion compensation, respectively, of the expansion joint construction. The adjustment element(s) may, for example, comprise at least one engagement element for mutual engagement with a gear of a gear drive. Especially, each of the elements may be a section of a rack or a chain. The adjustment element(s) and the respective element (s) for taking up a force may be constructed as separate parts which are connected by a connecting device or method (e.g. screws, welding, etc.) or instead each of the adjustment elements and element(s) for taking up a force connected thereto may be formed as an integral part.

In one or more embodiments, the expansion joint construction may have at least one elastic element which applies a force to the adjustment element. In particular, one elastic element may be arranged on each side of the at least one (or more) adjustment elements. In one or more embodiments, the elastic element may be a passive elastic element.

In one or more embodiments, the adjustment element or several adjustment elements (respectively) may be subjected to an elastic force applied to both sides of the adjustment element and adjustment elements, respectively.

In one or more embodiments, the adjustment element or several adjustment elements may comprise elastic elements on both sides which adjust the adjustment elements.

In one or more embodiments, the elastic element(s) may comprise spring elements, in particular disc springs, helical springs, friction springs, annular springs, leaf springs and/or rubber springs.

In one or more embodiments, the expansion joint construction has at least one active component for displacing the adjustment element(s).

In one or more embodiments, the adjustment element and elements, respectively, may be constructed as rail sections of a rail track. The longitudinal direction may be the direction of a rail track and/or the direction of expansion of a rail.

In one or more embodiments, the adjustment element(s) may comprise at least one engagement element for mutual engagement with a gear of a gear drive.

In one or more embodiments, the expansion joint construction may have a drive, and the expansion joint structure may be elastically reversibly compressible by actuating the drive in the longitudinal direction in order to generate an open gap between two sections that are to be bridged by the expansion joint construction.

In one or more embodiments, the drive/actuator may comprise a kinematics (e.g. a knee joint), a gear drive, a cable drive, a toothed belt and/or an actuator drive, which comprises in particular an adjusting cylinder or hydraulic cylinder. The drive or power transmission can also be carried out in any other reasonable way known to a person skilled in the art. The drive (actuator) can be located inside or outside a rail/pipe. For example, it can be located in the gap between the adjacent rail ends. Alternatively, it can be integrated in the expansion joint construction in other ways.

In one or more embodiments, a rail system for a transport system according to the invention comprises at least one rail having at least one expansion joint construction, wherein the expansion joint construction comprises at least one adjustable element being movable in the longitudinal direction of the rail.

In one or more embodiments, a rail system for a transport system according to the invention comprises at least one rail and at least one expansion joint construction as described in this application. I.e. the rail system may have an expansion joint construction having any of the properties described herein.

In one or more embodiments, the expansion joint structure may have a drive, and the expansion joint structure may be elastically reversibly compressible by actuating the drive in the longitudinal direction of the rail to generate an open gap between two rail sections.

In one or more embodiments, the rail system may have a second fixed rail portion, and the laterally displaceable rail portion may have a second end, wherein the expansion joint structure or another expansion joint structure is arranged to generate an open gap between the end of the second fixed rail portion and the second end of the laterally displaceable rail portion when a drive/actuator is actuated.

In one or more embodiments, the expansion joint construction is designed and arranged to compensate for changes in the length of the rail system.

In one or more embodiments, the expansion joint construction may be designed and arranged for reducing the gap width of a gap provided in the area of a switch or of a transfer platform.

In one or more embodiments, the expansion joint construction can be used for roller coasters or be applied in tubular rails, for example, but in general it can be used for any rail-guided transport systems (incl. e.g. crane systems).

For example, in most roller coaster facilities there is a so-called maintenance or buffer area for vehicles, into which vehicles are transported for maintenance via a shifting device. In order to ensure a smooth displacement, a certain gap must be generated between the rail track and the rails of the shifting section. Taking thermal expansion into account, the gap must be dimensioned in such a way that it functions at a certain maximum temperature at any time of the year without jamming, while avoiding any unnecessary disturbance of the passengers and any unnecessary wheel loads when the gap is traversed at a predetermined minimum temperature. In order to prevent large impacts, in conventional systems the vehicles drive over this point at a reduced speed. In order to avoid these restrictions, according to one or more embodiments the gap is bridged at least partially or in sections by an inventive expansion joint construction.

In one or more embodiments, the adjustment element is subjected to elastic force on both sides thereof. The adjustment element (or several adjustment elements) (each) may have elastic elements on both sides thereof which adjust each adjustment element properly and exactly.

In one or more embodiments, instead of or in addition to the passive elastic components mentioned above, passive double-acting compact cylinders can also be used, which are interconnected. In the event of compression due to heating, the cylinders are compressed and the hydraulic oil escapes into a tank. In the event of an increase of the gap, e.g. as a result of cooling of the rail, the cylinder can suck hydraulic oil out of the tank again. The valves are designed in such a way that the driving force applied to the rails does not lead to any oil loss, but the cylinders give way when any force due to thermal expansion is applied.

In one or more embodiments, alternatively or in addition to elastic elements, the expansion joint construction may have at least one active component for displacing the adjustment element(s). The active component may, for example, include a compact cylinder or alternative actuators, whereby as a rule a distance measuring system is required for control.

In one or more embodiments, the adjustment element or elements may be designed as rail sections.

In one or more embodiments, the adjustment element(s), or at least some of the adjustment elements, may comprise or carry at least one engagement element each for toothing of a gear drive. In this case the drive force is transmitted from a drive wheel (gear wheel) to the rails via a positive fit engagement with the engagement elements.

In one or more embodiments, in transport systems with positive fit drive, usually an engaging element is stationarily arranged along the track (at least in sections), e.g. a gear rack or a chain, whereby e.g. a gear wheel of a drive attached to the vehicle engages in the engaging element and drives the vehicle. If the engagement element is firmly attached to the rail construction, as in conventional rail systems, the permissible pitch error may exceed in the area of the gap due to temperature dependent expansion/contraction. Exceeding or falling below this value inevitably leads to faulty engagement and thus to faster wear of the toothing or the drive rollers. At the same time, the requirements for an expansion joint for length compensation due to temperature fluctuations must be taken into account.

With the help of one or more embodiments of the present invention, both requirements can be fulfilled. In addition to complying with the requirements regarding the pitch error, even at the transition point (gap) the system can transfer the maximum drive force at any time and the transition point (gap) can be passed at maximum speed. At the same time, linear expansion (due to temperature variation) can be compensated without the gap or pitch error becoming too large. In one or more embodiments, the solution can also be regarded as a combination of an expansion joint and a distribution of the pitch errors over a certain length.

In one or more embodiments, the rail system may have a first fixed rail section and a laterally/transversally displaceable intermediate rail section. The expansion joint structure may be arranged between one end of the first fixed rail section and a first end of the laterally displaceable rail section in order to be capable of generating a gap when it is required. In this case the expansion joint construction serves to close the gap between the fixed rail section and the movable rail section during operation of the transport system and to open it when the displaceable rail section must be laterally moved. A lateral/transverse displacement is meant to be a displacement of the entire movable rail section, e.g. into a position parallel to the fixed rail section (as in the case of a transfer platform), or a lateral displacement of one end of the movable section (as in the case of a switch). In the latter case, the movable section is usually swiveled a few degrees so that its end is moved from the end of the fixed rail section to a position to the side (e.g. towards the end of another fixed rail section).

In one or more embodiments, in addition, the expansion joint can also be used to compensate for stresses in the track due to thermal expansion. In the case of a positive fit drive, engagement elements arranged in the area of the expansion joint construction can contribute to avoid excessive pitch errors and allow good tooth engagement in any expansion joint position.

In one or more embodiments, the rail system may have a second fixed rail section, and the laterally displaceable rail section may have a second end, wherein the expansion joint structure or another expansion joint structure is disposed between one end of the second fixed rail section and the second end of the laterally displaceable rail section. The described advantages are realized in this construction by providing an inventive expansion joint construction for each of the gaps.

In one or more embodiments, in normal travel operation the rail system is locked, i.e. in this state the gap bridged by the expansion joint construction can be crossed at maximum speed and with transfer of maximum drive force. The drive (actuator), e.g. a hydraulic cylinder, moves a clamping or locking pin into a locking area which is arranged in the end area of the adjacent stationary rail section, up to a stop. The hydraulic cylinder is then depressurized and the valves are opened in both directions. In this state the mechanics is in passive mode and the expansion joint construction serves as an expansion joint. The existing bridged gap represents the initial state, which corresponds to a previously calculated installation temperature of the switch. In the event of expansion, i.e. reduction of the gap width, this difference is compensated by all adjustment elements, each of them supported on both sides by elastic elements. The difference is distributed to all the intermediate distances arranged between the adjustment elements. In this way, a permissible division error (pitch error) can be achieved. When passing over the switch the drive force is completely absorbed by the disc springs without any noticeable displacement. Larger linear expansions due to thermal expansion can be compensated by several modules/expansion joint constructions connected in series.

In one or more embodiments, the number of adjustment elements and their distances must be selected according to requirements and general conditions.

In one or more embodiments, in an unlocked state, in which the laterally displaceable section is to be moved laterally, the tensioning or locking bolt of the actuator of the expansion joint construction is moved out of the connecting piece of the adjacent stationary rail section by, for example, actuating a hydraulic cylinder. In this state, the hydraulic cylinder clamps the entire mechanics over the clamping or locking pin, so that there is an unbridged (open) gap between the end of the stationary/fixed rail sections and the end of the laterally movable rails section. In the next step, the moveable rail section can be pushed laterally to the maintenance track (transversely relative to the longitudinal axis of the rail).

In one or more embodiments, in order to reconnect the moveable rail section to the fixed rail section, the moveable rail segment is moved back to its original position. The hydraulic cylinder is extended again, so that the mechanism relaxes under the influence of the disc springs, thereby closing/bridging the open gap. In the last step, the clamping or locking bolt moves back into the connecting piece of the stationary rail section.

In one or more embodiments, the system makes sense for use with any rail-bound transport systems, especially on amusement rides such as roller coasters etc.

BRIEF DESCRIPTION OF THE FIGURES

Further features and advantages of the invention will become clear from the description of preferred embodiments based on the following figures.

DETAILED DESCRIPTION

Figure 1:
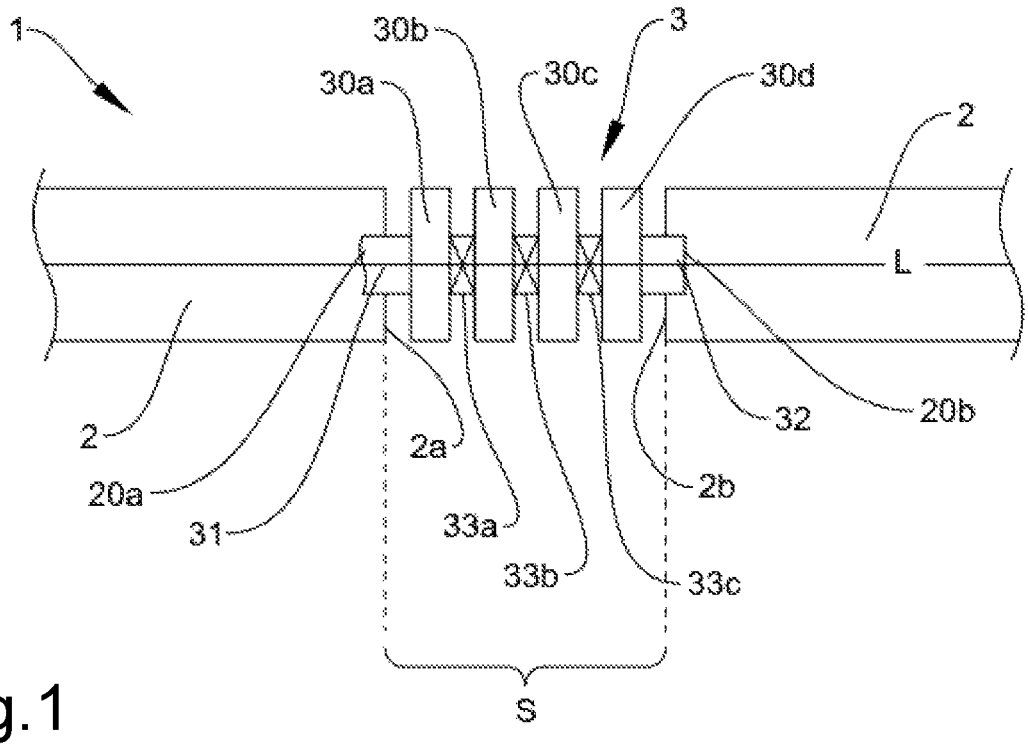
FIG. 1 is a sectional view of a section of the rail system according to a first embodiment.

FIG. 1 shows a sectional view of a section of a rail system 1 according to a first embodiment of the invention.

The rail system 1 has a stationary rail section 2, which is interrupted by a gap. The gap is located between a first end 2*a* of the rail section 2 and a second opposite end 2*b* of the rail section 2.

The inventive expansion joint construction 3, which bridges the gap, is arranged in the gap. In this embodiment, the expansion joint construction 3 has four adjustment elements 30*a*, 30*b*, 30*c*, 30*d*, which are designed as rail sections. This means that the adjustment elements 30*a*, 30*b*, 30*c*, 30*d* essentially have a cross-section profile corresponding to the cross-section profile of the rail section 2. On the sides adjacent to the first ends 2*a* and second end 2*b* of rail section 2, the expansion joint structure 3 has connecting elements 31 and 32 (in this case in the form of projections) which engage in corresponding connections 20*a*, 20*b* of rail section 2 (in this case in the form of complementary recesses matching the connecting elements 31 and 32).

Elastic elements which in this embodiment of the invention are disc springs 33*a*, 33*b*, 33*c* are arranged between the adjustment elements 30*a*, 30*b*, 30*c*, 30*d*. The springs generate an elastic stress which presses the connection elements 31 and 32 apart from each other along a longitudinal axis L of the rail section 2. When the gap width is reduced, the elastic elements 33*a*, 33*b*, 33*c* are compressed. The disc springs 33*a*, 33*b*, 33*c* are so compressible that if the width S of the gap changes, at least some of the adjustment elements 30*a*, 30*b*, 30*c*, 30*d* can shift along the longitudinal axis L. The change in the gap width, e.g. due to a (temperature-related) change in length of the rail section 2 on the left and/or right side of the gap, is distributed to the movable adjustment elements 30*b*, 30*c* according to the number of movable adjustment elements 30*b*, 30*c* arranged in the gap. The change in the resulting gap width between adjacent adjustment elements 30*a*, 30*b*, 30*c*, 30*d* is smaller as the number of movable adjustment elements 30*b*, 30*c* is increased.

In order to prevent the adjustment elements 30*a*, 30*b*, 30*c*, 30*d* from moving sideways, a guide (not shown) may be provided which limits the movement of the adjustment elements 30*a*, 30*b*, 30*c*, 30*d* and only allows a linear movement in the direction of the longitudinal axis L.

By providing the inventive construction even large gaps S in rail section 2 may be bridged without the vehicle being hit and the occupants being shaken when the gap is passed over. In addition, the load on the wheels of the vehicles and on the axle construction is reduced. In addition, the speed characteristic of a roller coaster ride, for example, is not restricted because the invention does not require the gap to be crossed at reduced speed even at low temperatures.

In case of a positive fit drive, the adjustment elements may carry engagement elements (not shown) which are separated from each other.

Figure 2:
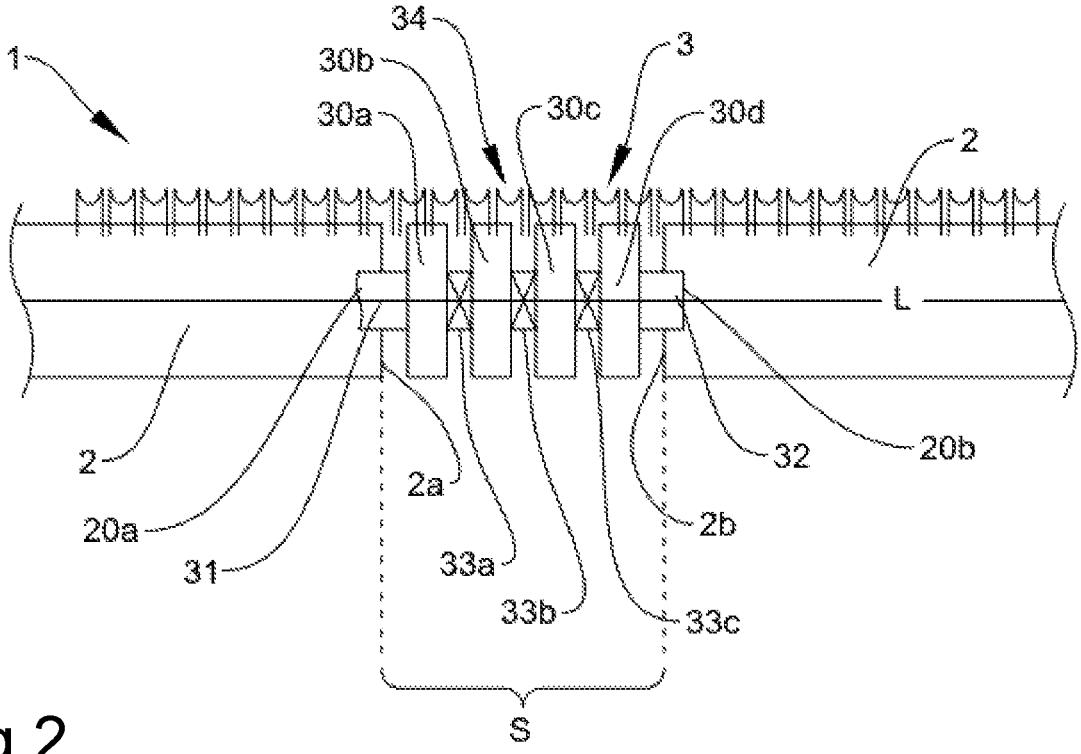
FIG. 2 is a sectional view of a section of a rail system according to another embodiment.

FIG. 2 shows a second embodiment of a section of the rail system 2 according to the invention, whereby identical components of the system 1 according to the first embodiment are designated with the same reference signs. The above descriptions also apply to the corresponding components of the second embodiment.

In contrast to the first embodiment, however, the adjustment elements 30*a*, 30*b*, 30*c*, 30*d* are equipped with tooth elements, which are intended for supporting engagement elements 34 of a form-fit drive (positive fit drive). In the present case, each adjustment element carries two tooth elements, but it could also be only one or less, or more than two elements. The track-side engagement elements 34 (in FIG. 2 only one of the engagement elements is marked with an arrow as an example) can, for example, be chain links that can interact with a gear wheel of a vehicle (not shown).

In this embodiment the adjustment elements 30*a*, 30*b*, 30*c*, 30*d* carry the engagement elements which are part of a positive fit drive. In this embodiment the adjustment elements 30*a*, 30*b*, 30*c*, 30*d* and/or the rail 2 may just be carriers for elements, and they may or may not be additionally guide rails for a vehicle. I.e. the rail 2 and the adjustment elements 30*a*, 30*b*, 30*c*, 30*d* may have one or more functions, namely, being at least a guide rail, being a carrier for engagement elements or both.

With conventional rail systems, a gap can be provided which acts as an expansion joint. The problem may be that due to the thermal expansion, as already described, the size S of the gap varies. By changing the gap width S, a division error is generated between the left and right-hand side engagement elements 34. In order to prevent the gap from becoming too large, according to the invention the total width of the gap is distributed to various rack/chain elements. Furthermore, the width of the gap is distributed to the "adjustable" (i.e. moveable along the longitudinal axis L) engagement elements 34 which are attached to the adjustment elements 30*a*, 30*b*, 30, 30*d*. The adjustment elements 30*a*, 30*b*, 30, 30*d* or rack and pinion elements, chain holders, chain holder holders and/or engagement elements, for example, are directly or indirectly separated from one another by disc springs. When the rail is expanded, the change in length of rail 2 is distributed over several movable adjustment elements 30*b*, 30*c*, in the present embodiment to the two middle adjustment elements 30*b*, 30*c*. Of course, the design could be modified by also providing disc springs between the connection elements 31 and 32 and the adjacent adjustment elements 30*a* and 30*d*, respectively. This would allow the pitch error to be distributed to all adjustment elements 30*a*, 30*b*, 30*c*, 30*d*.

In case of an expansion or a reduction of the gap width S, a fraction of the total gap expansion/gap reduction can be compensated by the mechanism—depending on the constructive requirements. The pitch error is divided between several rack elements and can be reduced to a value within the permissible tolerance. The drive force when passing over the gap is completely absorbed by the disc springs 33*a*, 33*b*, 33*c* without any noticeable displacement.

Larger changes in length or changes in the gap width due to thermal expansion could be compensated by arranging several modules/expansion joint constructions 3 in series.

Figure 3:
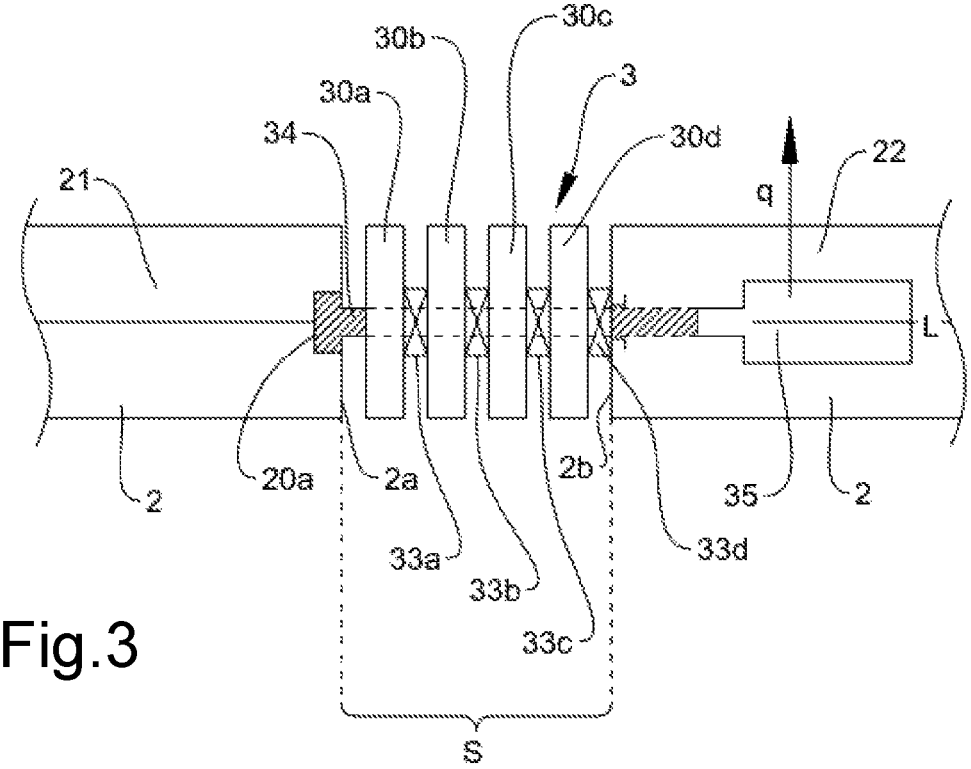
FIG. 3 shows another embodiment of a rail system in a first state.

FIG. 3 shows a third embodiment of a section of the rail system 2 according to the invention, whereby the same components of the system are designated with the same reference signs as in connection with the previous embodiments. The above descriptions also apply to the corresponding components of the third embodiment.

In this design the expansion joint construction 3 is shown in connection with a switch or a transfer section.

In this embodiment the rail system 2 has a first stationary rail section 21 and a second rail section 22 which can be displaced transversely or perpendicularly to the longitudinal direction L. A first end 20*a* of the stationary rail section 21 is opposite an end 20*b* of the second rail section. In between there is an expansion joint construction 3 with components as described above. In this embodiment, however, four disc springs 33*a*, 33*b*, 33*c*, 33*d* are provided. Both sides of the adjustment elements 30*b*, 30*c* and 30*d* are equipped with a spring 33*a*, 33*b*, 33*c*, 33*d*. Instead of the connection element 31, an actuation slide 34 is provided in this embodiment. The actuation slide 34 is coupled to a drive, e.g. a hydraulic cylinder 35, in order to be driven by it.

In the state shown in FIG. 3, the operating slide 34 is extended and engages in the depression 20*a* of the rail section 21. In this state, the construction 3 bridges the gap between the ends 2*a* and 2*b* of rail sections 21 and 22 and can serve as an expansion joint as described above.

However, in order to move the movable rail section 22 transversely or perpendicularly to the longitudinal axis L, as indicated by arrow q, a gap between the end 2*a* of the stationary rail section 21 on the one hand and the end of the movable rail section 22 on the other hand must be generated. Therefore, the expansion joint construction 3 is retracted, i.e. the gap must be enlarged so as to ensure smooth lateral movement of section 22 even with minimum gap width S. In other words, the longitudinal extension of the expansion joint construction 3 (which bridges gap S in the first state) must be reduced so that a sufficiently large open gap S' is created between the stationary and laterally movable components.

Figure 4:
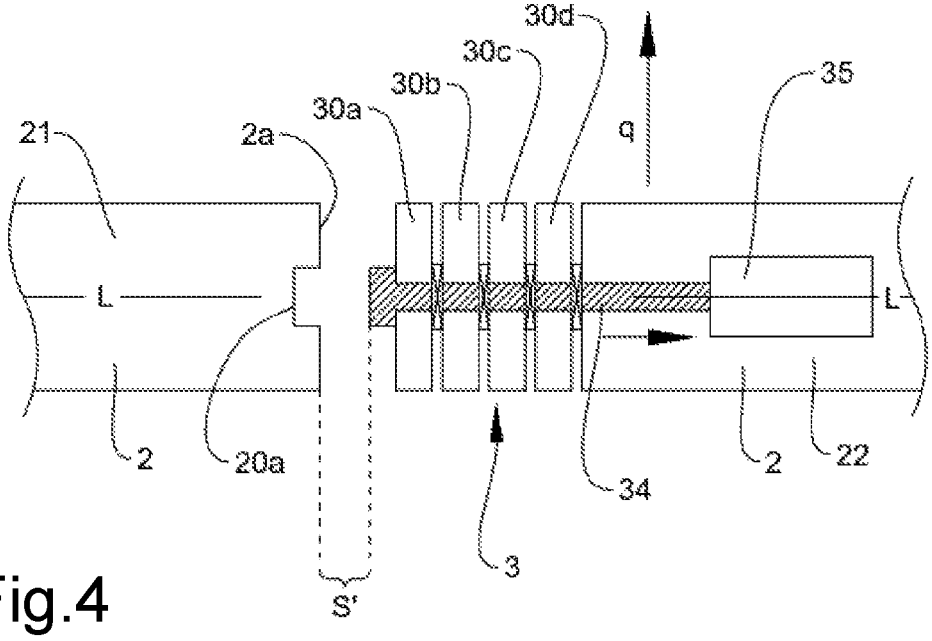
FIG. 4 shows a section of the rail system of FIG. 3 in a second state.

This state with a generated open gap S' is shown in FIG. 4. In this illustration, the actuation slide 34 was driven by the actuator 35 so that the springs 33*a*, 33*b*, 33*c*, 33*d* were compressed and the distance between the adjustment elements 30*a*, 30*b*, 30*c*, 30*d* was reduced. This reduction of the distances results in a non-bridged, open gap S' between the stationary component 21 and the laterally movable components 3, 22 (the expansion joint construction 3 and the movable rail section 22 (switch section)).

In case the other end (not shown) of the moveable rail section 22 is also connected to a stationary rail section, or separated by a gap, the movable rail section 22 may have the same expansion joint construction 3 at the other end. Rail section 22 can thus be completely moved laterally across the longitudinal direction to a parallel rail track after the expansion joint constructions have been compressed in such a way that the gap S is no longer completely bridged, resulting in an open gap S'.

Of course, the construction described in connection with FIGS. 3 and 4 is also conceivable as a rail construction having or not having engagement elements 34 for a form-fit (positive fit) drive, as described in connection with the embodiment shown in FIG. 2.

In one or more embodiments, a rail system 1 has a stationary rail section 2, which is interrupted by a gap. The gap is located between a first end 2*a* of the rail section 2 and a second opposite end 2*b* of the rail section 2. An expansion joint construction 3 is arranged in the gap, which bridges the gap. The expansion joint construction 3 has adjustment elements 30*a*, 30*b*, 30*c*, 30*d*, with elastic elements 33*a*, 33*b*, 33*c* being arranged between the adjustment elements 30*a*, 30*b*, 30*c*, 30*d*, which generate an elastic tension. When the gap width is reduced, the elastic elements 33*a*, 33*b*, 33*c* are compressed.

The present disclosure may include one or more of the following concepts:

Paragraph A. An expansion joint construction (3) comprising at least one adjustment element (30*a*, 30*b*, 30*c*, 30*d*) movable in a longitudinal direction of the construction (3), wherein at least one adjustment element (30*b*, 30*c*, 30*d*) comprises at least one element (34) for taking up a force applied in a longitudinal direction.

Paragraph B. The expansion joint construction (3) according to Paragraph A, wherein the expansion joint construction (3) has at least one elastic element which applies a force to the adjustment element.

Paragraph C. The expansion joint construction (3) according to Paragraph A, wherein the adjustment element or at least one of the adjustment elements (30*b*, 30*c*, 30*d*) is or are subjected to an elastic force applied to both sides of the adjustment element and adjustment elements, respectively.

Paragraph D. The expansion joint construction (3) according to Paragraph B, wherein at least one adjustment element or several adjustment elements (30*b*, 30*c*, 30*d*) comprise elastic elements (33*a*, 33*b*, 33*c*, 33*d*) arranged at both sides thereof which adjust the adjustment elements (30*b*, 30*c*, 30*d*).

Paragraph E. The expansion joint construction (3) according to Paragraph B, wherein the elastic element(s) (33*a*, 33*b*, 33*c*, 33*d*) comprise spring elements, in particular disc springs, helical springs, friction springs, annular springs, leaf springs and/or rubber springs.

Paragraph F. The expansion joint construction (3) according to Paragraph A, wherein the expansion joint construction (3) has at least one active component for displacing the adjustment element(s).

Paragraph G. The expansion joint construction (3) according to Paragraph A, wherein the adjustment element or elements (30*a*, 30*b*, 30*c*, 30*d*) are designed as rail sections.

Paragraph H. The expansion joint construction (3) according to Paragraph A, wherein the element (34) for taking up a force applied in a longitudinal direction comprises at least one engagement element (34) for mutual engagement with a gear of a gear drive.

Paragraph I. The expansion joint construction (3) according Paragraph A, wherein the expansion joint construction (3) has a drive (35), the expansion joint structure (3) being elastically reversibly compressible by actuating the drive (35) in the longitudinal direction (L) in order to generate an open gap (S') between two sections (21, 22).

Paragraph J. The expansion joint construction (3) according to Paragraph I, wherein the drive (35) comprises a kinematics, a gear drive, a cable drive, a toothed belt and/or an actuator drive, which comprises in particular an adjusting cylinder or hydraulic cylinder.

Paragraph K. A rail system (1) for a transport system, comprising at least one rail (2) having at least one expansion joint construction (3), wherein the expansion joint construction (3) comprises at least one adjustable element (30*a*, 30*b*, 30*c*, 30*d*) which is movable in the longitudinal direction of the rail, wherein at least one adjustment element (30*b*, 30*c*, 30*d*) comprises at least one element (34) for taking up a force applied in a longitudinal direction.

Paragraph L. A rail system (1) for a transport system, comprising at least one rail (2) and at least one expansion joint construction (3) according to Paragraph A.

Paragraph M. The rail system (1) according to Paragraph K, wherein the expansion joint structure (3) has a drive (35), the expansion joint structure (3) being elastically reversibly compressible by actuating the drive (35) in the longitudinal direction (L) of the rail to generate an open gap (S') between two rail sections (21, 22).

Paragraph N. The rail system (1) according to Paragraph K, wherein the rail system (1) comprises a first stationary rail section (21) and a second laterally displaceable rail section (22), the expansion joint structure (3) being arranged between one end (2*a*) of the first fixed rail section (21) and a first end (2*b*) of the laterally displaceable rail section (22) to generate an open gap (S').

Paragraph O. The rail system (1) according to Paragraph N, wherein the rail system (1) has a second fixed rail portion, and the laterally displaceable rail portion (22) has a second end, wherein the expansion joint structure (3) or another expansion joint structure is arranged to create an open gap between the end of the second fixed rail portion and the second end of the laterally displaceable rail portion (22).

Paragraph P. The rail system (1) according to Paragraph K, wherein the expansion joint construction (3) is designed and arranged to compensate for changes in the length of the rail system.

Paragraph Q. The rail system (1) according to Paragraph K, wherein the expansion joint construction (3) is designed and arranged for reducing the gap width of a gap provided in the area of a switch or of a transfer platform.

Although the present disclosure has shown and described the foregoing operational principles and embodiments, it will be apparent to those skilled in the art that various changes in form and detail may be made without departing from the spirit and scope of the disclosure. All such alternatives, modifications and variances should be considered to be included within the scope of the present disclosure.

What is claimed is:

1. An expansion joint construction comprising at least one adjustment element movable in a longitudinal direction of the expansion joint construction, wherein the at least one adjustment element comprises at least one element for taking up a force applied in the longitudinal direction, and wherein the at least one element adapted for taking up a force in the longitudinal direction comprises at least one engagement element adapted for mutual engagement with a gear of a gear drive.

2. The expansion joint construction according to claim 1, wherein the expansion joint construction has at least one elastic element which applies a force to the at least one adjustment element.

3. The expansion joint construction according to claim 2, wherein the elastic element(s) comprise disc springs, helical springs, friction springs, annular springs, leaf springs, and/or rubber springs.

4. The expansion joint construction according to claim 2, wherein the at least one elastic element comprises a plurality of elastic elements, and wherein the at least one adjustment element includes at least a first adiustment element having elastic elements arranged at both sides of the first adjustment element and configured to adjust the first adjustment element.

5. The expansion joint construction according to claim 2, wherein the elastic element(s) comprise spring elements.

6. The expansion joint construction according to claim 1, wherein the at least one adjustment element includes at least a second adjustment element subjected to an elastic force applied to both sides of the second adiustment element.

7. The expansion joint construction according to claim 1, wherein the expansion joint construction has at least one active component for displacing the at least one adjustment element.

8. The expansion joint construction according to claim 1, wherein the at least one adjustment element includes at least one adjustment element configured as a rail section.

9. The expansion joint construction according to claim 1, wherein the expansion joint construction has a drive, the expansion joint construction being elastically reversibly compressible by actuating the drive in the longitudinal direction in order to generate an open gap between two sections.

10. The expansion joint construction according to claim 9, wherein the drive comprises a kinematics, a gear drive, a cable drive, a toothed belt and/or an actuator drive.

11. A rail system for a transport system, comprising at least one rail and at least one expansion joint construction according to claim 1.

12. A rail system for a transport system, comprising at least one rail having at least one expansion joint construction, wherein the expansion joint construction comprises at least one adjustable element which is movable in a longitudinal direction of the rail, wherein the at least one adjustable element comprises at least one element adapted for taking up a force applied in the longitudinal direction, and wherein the at least one element adapted for taking up a force applied in the longitudinal direction comprises at least one engagement element adapted for mutual engagement with a gear of a gear drive.

13. The rail system according to claim 12, wherein the expansion joint construction has a drive, the expansion joint construction being elastically reversibly compressible by actuating the drive in the longitudinal direction of the rail to generate an open gap between two rail sections.

14. The rail system according to claim 13, wherein the rail system comprises a first fixed rail section and a second laterally displaceable rail section, the expansion joint construction being arranged between one end of the first fixed rail section and a first end of the second laterally displaceable rail section, such that actuating the drive in the longitudinal direction of the rail generates a first open gap between the first fixed rail section and the second laterally displaceable rail section.

15. The rail system according to claim 14, wherein the rail system has a second fixed rail section, and the second laterally displaceable rail section has a second end, wherein a second expansion joint construction is arranged between one end of the second fixed rail section and the second end of the second laterally displaceable rail section, such that actuating a drive of the second expansion joint construction in the longitudinal direction of the rail generates a second open gap between the second fixed rail section and the second laterally displaceable rail section.

16. The rail system according to claim 12, wherein the expansion joint construction is configured and arranged to compensate for changes in a length of the rail system.

17. The rail system according to claim 12, wherein the expansion joint construction is configured and arranged for reducing a gap width of a gap provided in an area of a switch or of a transfer platform.

* * * * *